United States Patent [19]

Taylor et al.

[11] 4,154,187

[45] May 15, 1979

[54] NON-FOULING ANCHOR

[75] Inventors: James M. Taylor, West Palm Beach; Lawrence E. Beattie, Pompano Beach, both of Fla.

[73] Assignee: Wishbone Marine Products, Inc., Pompano Beach, Fla.

[21] Appl. No.: 747,800

[22] Filed: Dec. 6, 1976

[51] Int. Cl.[2] ..... B63B 21/40

[52] U.S. Cl. ..... 114/306; 114/304

[58] Field of Search ..... 114/306, 307, 308, 309, 114/304

[56] References Cited

U.S. PATENT DOCUMENTS

| | | | |
|---|---|---|---|
| 86,206 | 1/1869 | Brown | 114/306 |
| 144,901 | 11/1873 | Hall | 114/306 |
| 298,867 | 5/1884 | Lewis | 114/306 |
| 347,972 | 8/1886 | Spedden | 114/306 |
| 2,478,342 | 8/1949 | Thompson | 114/306 |
| 3,022,761 | 2/1962 | De Beixedon | 114/306 |
| 3,022,762 | 2/1962 | Hillcourt | 114/306 |

*Primary Examiner*—Trygve M. Blix
*Assistant Examiner*—Sherman D. Basinger
*Attorney, Agent, or Firm*—Eugene F. Malin; Barry L. Haley

[57] ABSTRACT

A non-fouling fluked anchor having a yoke-like shank in which the yoke arms are arcuate and pivotally attached to a pointed, center mounted fluke such that the arcuate arms of the shank provide for variable positioning of the fluke point to insure initial penetration of the fluke point in sea floor bottoms having different degrees of hardness. The fluke tip, the yoke frame, and the anchor line tether establish a three point contact with the sea bottom. The arcuate yoke shank arms allow a variable initial penetration angle of the fluke from 15 degrees to approximately 67 degrees. As a relatively harder sea bottom is encountered the anchor, due to the action of the arcuate yoke will pivot to provide a steeper fluke angle to insure penetration. Once the fluke has penetrated the bottom the anchor will then assume the secured position at the conventional holding angle.

5 Claims, 7 Drawing Figures

NON-FOULING ANCHOR

BACKGROUND OF THE INVENTION

This invention relates generally to a non-fouling, fluked anchor, and specifically to an improved center fluke anchor which is capable of achieving penetration regardless of the condition of hardness of the ocean floor.

The prior art shows a plethora of fluked anchors in which all attempt to correct for various problems encountered in anchoring in general. Some examples of the prior art which suffer from various problems can be found in the following U.S. Pat. Nos.: 1,497,693, 2,130,120, 2,487,549, 2,696,187, and 2,733,678. First the fluke type anchor must penetrate the sea bottom and achieve approximately a 40° holding angle, but certain sea bottoms are too hard to penetrate. Second, fluke anchors tend to foul in weeds making penetration difficult. Third, if the boat shifts, oftentimes a fluke anchor will become disengaged from the sea floor bottom because of the forces on the anchor from the shift in the position of the boat and line. Finally, problems have been encountered with fluke anchors in removing the anchor when it is desirous to leave anchorage.

The prior art shows several anchors which suffer from the above deficiencies and especially the inability to penetrate different sea bottom hardness conditions encountered. The present invention provides a non-fouling fluked anchor which can adjust and penetrate sea bottoms having varying degrees of hardness by allowing for a variable initial penetrating angle through the use of arcuate shank arms pivotally attached to a single pointed fluke.

Prior art anchors have often used a stock to level the anchor in order to achieve a proper penetrating angle into the sea bottom. The stock, however, usually comprised of an extended rod on each side of the anchor, itself can easily become fouled in weeds, rocks and the like reducing the overall efficiency of the anchor. Also, the stock will not provide for varying the penetrating angle but merely acts to keep the anchor itself horizontal while it is dragged along the sea bottom. The present invention eliminates the protruding stock and as such, will not become fouled in weeds, grass, rock, or coral and prevents fouling of the anchor line.

In the prior art, U.S. Pat. No. 3,022,762 issued to C. W. Hillcourt on Feb. 27, 1962 shows a single fluke anchor having a frame pivotally attached to the fluke. The Hillcourt anchor has straight, flat shank frame arms and does not, as has been determined, provide for penetration in different sea bottoms having varying degrees of hardness. The instant invention, although having an overall appearance somewhat similar to Hillcourt operates quite differently and is an improvement over the Hillcourt anchor in that in the instant invention it has been determined that the arcuate yoke-like shank arms in conjunction with the fluke point which is maintained at a pre-determined distance from the arcuate apex will provide an anchor that can vary the penetrating initial angle between 15° and 67° to achieve an initial penetration which allows the fluke to become firmly embedded into the sea bottom regardless of the hardness of the sea bottom. In a relatively softer sea bottom, a small fluke-bottom angle initially, will begin the penetration of the fluke which will become stabilized between 35° and 40° at the final penetration, holding angle. In a hard bottom (where a sharp penetrating initial angle is desirous to provide greater penetration force) the arcuate shank yoke contact point with the sea bottom positions the fluke so as to penetrate the bottom at a larger initial penetration angle (up to approximately 67°) to achieve the initial penetration. As the fluke penetrates, the fluke kicker plate establishes a final fluke-bottom angle between approximately 35° and 40°. Should the boat and anchor line move, changing the relative angle between the boat and the anchor, the instant invention anchor will pivot around the fluke and quickly re-establish penetration through the action of the arcuate shank arms in conjunction with the fluke point.

BRIEF DESCRIPTION OF THE INVENTION

A non-fouling, single fluke anchor having a triangularly shaped fluke, said fluke having attached along its base edge a pair of angularly diverging trapezoidally shaped kicker plates, a shaft, said fluke being rigidly fixed to said shaft along its base edge, a shank, said shank being yoke-like and having a pair of circular arc shaped arms, said arms connected together at one end forming the apex of the shank frame and at their opposite ends to a transverse frame member. The fluke shaft is pivotally connected at each end inside of the arms of the frame. The fluke kicker plates are sized and angularly separated such that the rotation of the fluke on either side of the plane of the frame causes the transverse frame member to engage one or the other of the kicker plates to limit the angular movement of the fluke. The fluke apex and sides are spaced from the shank arms in accordance with a predetermined ratio to establish three point contact which provides a penetrating force on the fluke point. The apex of the shank also includes an attaching ring for securing a line to the anchor along the center line of the device. Each shank arm is formed as a segment of an arc of a circle, the radius being approximately twice the transverse width of the anchor. The shank arm is curved to define a circular arc between the apex of the shank and the pivotal connection where the shaft or fluke connects meets the base.

The instant invention provides a variable proper penetrating angle from 15° to 67° to accomodate sea bottoms of variable hardness. An angle of approximately 15° is the minimum fluke-bottom penetrating angle which is sufficient for initially penetrating a soft sea bottom after which time the anchor fluke rotates to 40° for maximum holding after penetration. If a harder bottom is encountered and the anchor fluke rotates to approximately 40° without penetrating, an increased angle is required to break the surface and to penetrate the bottom. It should be understood that any angle in excess of 40° must be temporarily maintained for purposes of penetration only and the anchor fluke will return to 40° after initial penetration to keep the anchor from pulling up and freeing itself when stress is applied between anchor and boat. The circular arc of the anchor shank frame arms allow for the temporary increase of the initial penetrating angle. Above 40°, as the anchor is dragged, drag on the fluke point causes the shank arm contact point to change, pivoting the anchor to a steeper angle until penetration is achieved. Once fluke penetration has begun and the anchor is pulled further, the fluke will become firmly embedded at a final holding angle.

It is an object of this invention to provide an improved, non-fouling, single fluke anchor.

It is another object of this invention to provide a non-fouling anchor which is capable of penetrating sea bottoms having varying degrees of hardness.

In accordance with these and other objects which will be apparent hereinafter, the instant invention will now be described with particular reference to the accompanying drawings.

A BRIEF DESCRIPTION OF THE DRAWINGS

PREFERRED EMBODIMENT OF THE INVENTION

Figure 1:
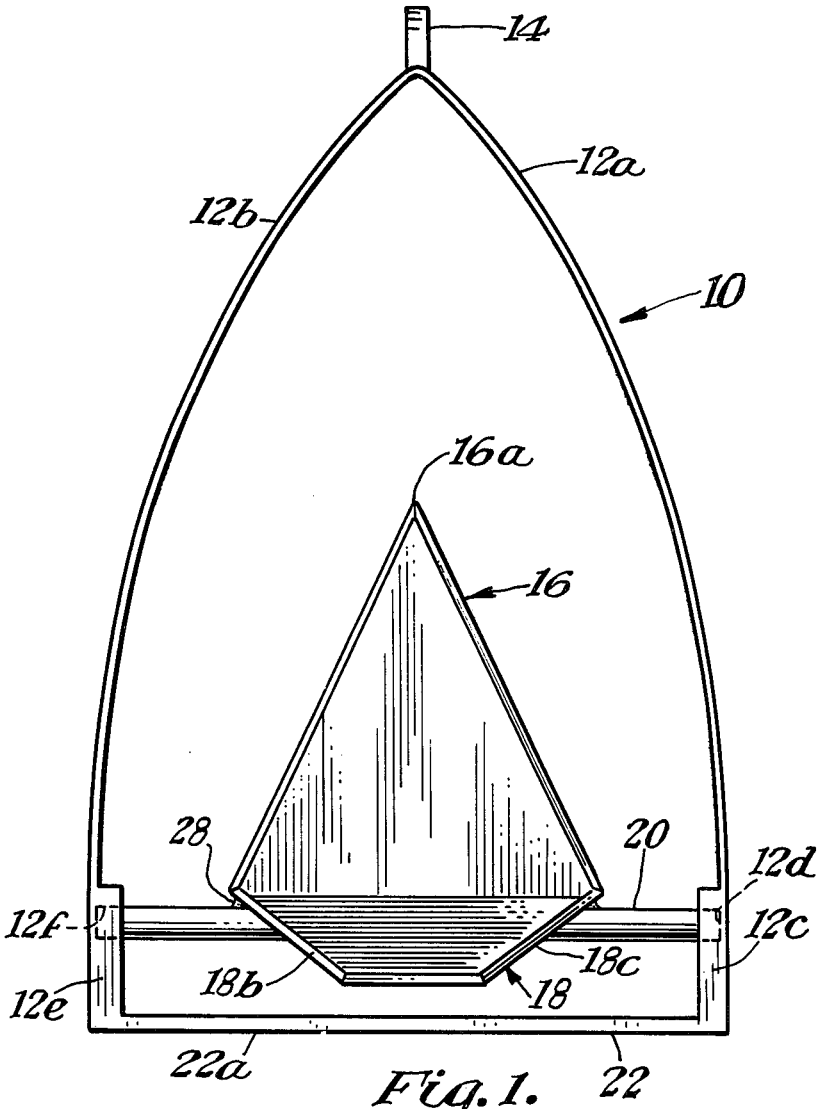
FIG. 1 shows a top plan view of the instant invention.
Figure 2:
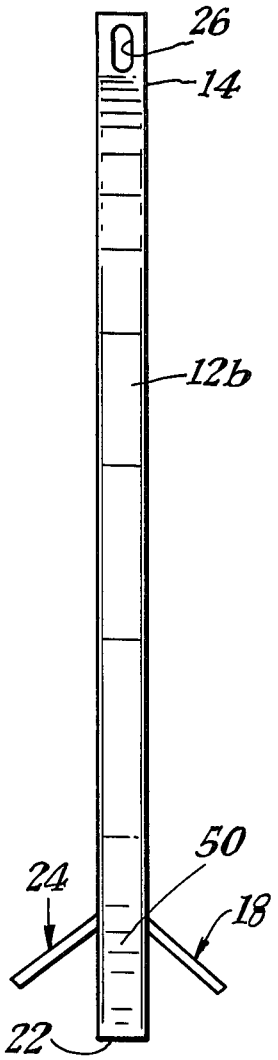
FIG. 2 shows a side elevational view of the instant invention.
Figure 3:
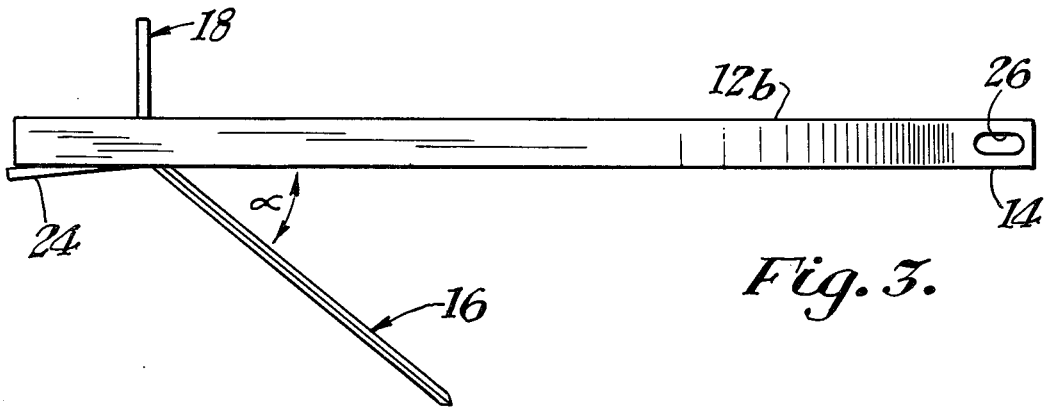
FIG. 3 shows a side elevational view of the instant invention in which the fluke is pivoted to its maximum position.

Referring now to the drawings and specifically FIG. 1, the instant invention is shown generally at 10 comprised of a triangular shaped, pointed fluke 16 having a sharp apex 16*a*, the fluke including a pair of diverging kicker plates 18 which are trapezoidally shaped, the kicker plates having edges 18*b* and 18*c* and a flat top edge 18*a*. Each kicker plate forms approximately a 120° angle with the fluke 16 and is rigidly affixed thereto. The fluke and kicker plates are welded to a rigid shaft 20 which is pivotally mounted in sockets 12*d* and 12*f* in base members 12*e* and 12*c* respectively. The base members 12*e* and 12*c* are connected together by rear cross frame arm 22 which has a top surface 22*a*. The surface 22*a* and its corresponding opposite surface on the other side of the base member 22 acts as a limiting member which engages kicker plate 18 stopping pivotal movement at the maximum desired fluke angle. FIG. 3 shows fluke 16 disposed at the maximum angle relative to the plane of the shank frame with kicker plate 24 engaging the rear cross frame member. Also shown in FIG. 3 is an anchor line connector in shank apex 14 having an aperture 26 for receiving a line to secure the anchor to a boat.

FIG. 1 shows the arcuate, circular arc shape of the shank arms 12*a* and 12*b* at the apex 14 down to the base member 12*e* and 12*c* on each side. Further, Applicant has determined that the distance from the fluke point 16*a* to the apex 14 is important in the design to insure positive initial penetration of the fluke point, which is discussed in greater detail below.

Figure 4:
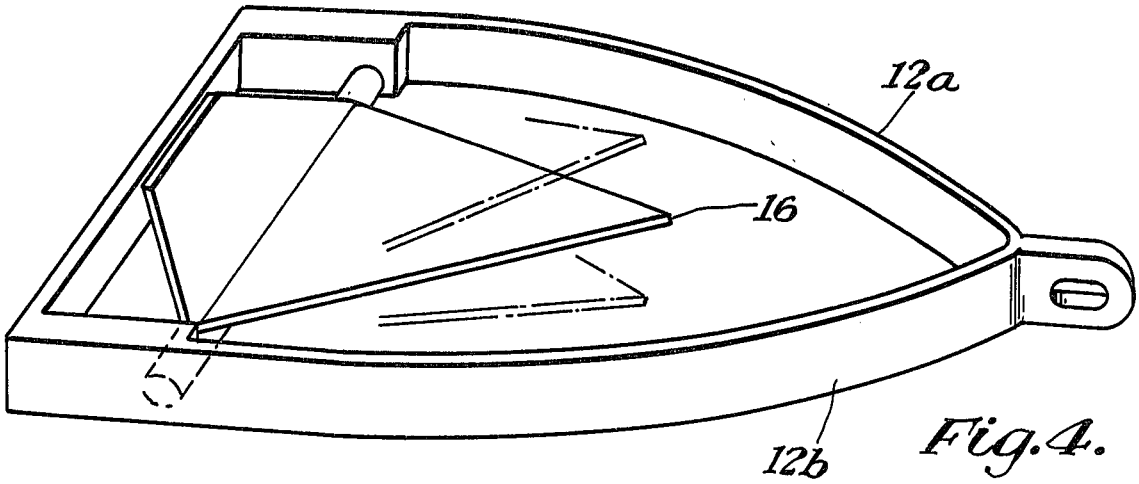
FIG. 4 shows a perspective view of the instant invention with the fluke blade movement angular position shown as dotted between its limits of movement.

FIG. 4 shows the angular displacement of fluke 16 above and below the plane formed by the rear frame cross member and the circular arc shaped shank arms 12*a* and 12*b*. The maximum angle permitted by the fluke from the central plane on either side is approximately 35° to 40°, which is the conventionally found maximum holding angle for a fluked anchor. The kicker plates act to define the maximum permitted angle of the fluke relative to the plane of the frame.

Figure 5:
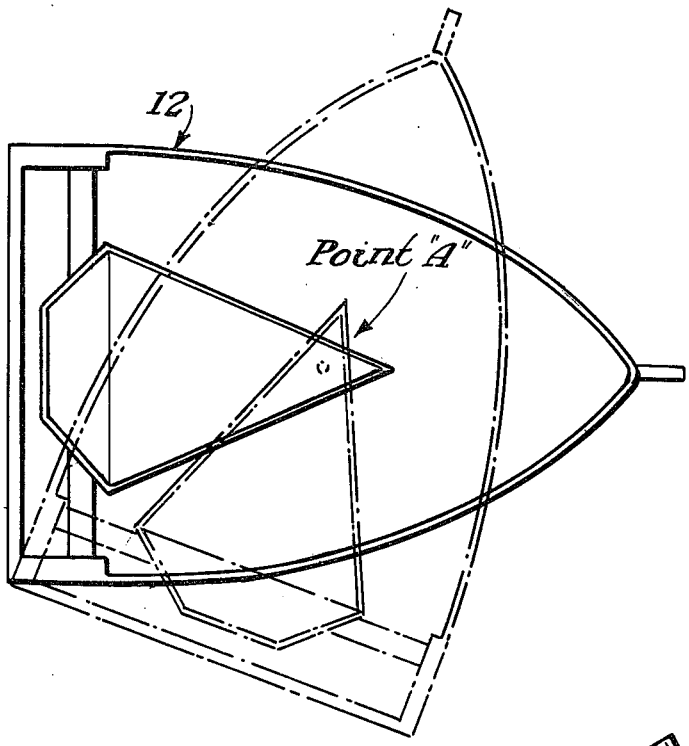
FIG. 5 shows a top plan view of the instant invention including a dotted view showing the pivotal function of the instant invention.

FIG. 5 shows a top plan view of the anchor of the instant invention in two various dispositions showing the pivot point A which shows how the anchor reacts to an angular movement relative to the central axis of the anchor. For example, should the tide or winds shift, causing a boat to move at anchorage such that the anchor itself will be pivoting on the bottom due to the change in direction of pull from the boat, with the instant invention anchor, the anchor merely pivots in position and can readily reestablish its holding angle to resist the pulling motion on the vessel at anchor. The pivot point is approximately near the fluke tip.

Figure 6:
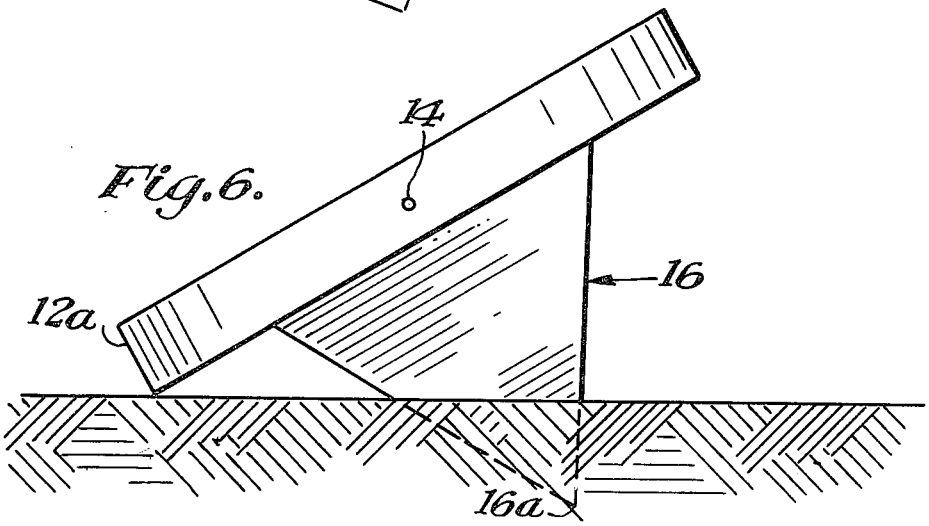
FIG. 6 is a front elevetional view showing the operation of the shank side in conjunction with a fluke point for establishing initial anchor penetration.

FIG. 6 shows how the initial penetration angle is established by allowing the fluke 16 to be received into the sea bottom at an angle greater than the conventional holding angle (approximately 40°) by the establishment of a three point contact plane determined by fluke point 16*a*, point b along the circular arc shaped shank arm such as shank arm 12*a* and point c which represents the anchor line connecting point and the point of pull established by the anchor line. As the anchor is dragged across the bottom, the fluke 16 encounters resistance, this increased resistance establishes a single contact point touching the sea bottom due to the circular arc shape of the shank member 12*a*, thereby the establishment of this single contact point has the tendency to increase the fluke penetration angle as more resistance is encountered. The significance of increasing the penetrating angle of the fluke into the sea bottom is that a greater force vector is experienced through the fluke angle into the ground to insure initial penetration. Once the fluke 16 is sufficiently embedded in the sea ground or sea bottom, additional pulling in conjunction with the kicker plate angle will establish the fluke at a final holding angle of approximately 40°. In the position shown in FIG. 6 a downward reactive force is established during initial penetration between the pulling action on the anchor line and the fluke angle, while the shank 12*a* rests at only one point along the shank and shank bottom. Many of the dimensional characteristics may be varied such as the length, width and elliptical curve of the frame including the distance from the pivot to the anchor line connector. Also the fluke length from the fluke apex to the shank apex is important and has been established that the fluke should be approximately one half the distance between the shank apex and the rear cross frame member.

Figure 7:
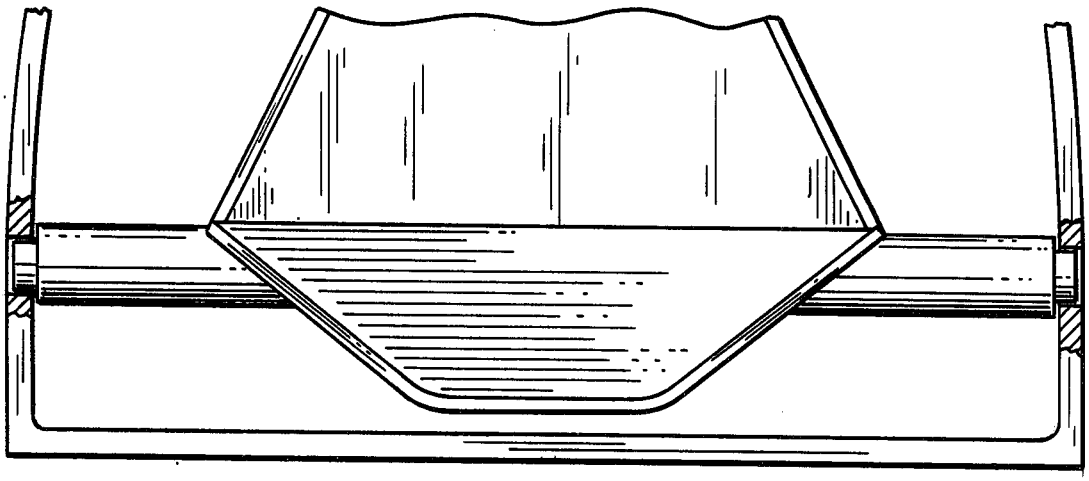
FIG. 7 shows an alternate embodiment of the instant invention in a top plan view.

FIG. 7 shows an alternate embodiment in which the shaft shank arm coupling is altered such that the shaft is pivotally mounted through the shank arm on each side.

In the preferred embodiment, the length of the fluke base is 8.86 inches while the shaft length of 14.76 inches which provides the optimum ratio between the fluke base and anchor transverse width with a fluke apex angle of 53°. The radius of arc of the shank arm is approximately twice the transverse width of the anchor (shaft length). The distance from shaft center to rear cross frame member is 2.50 inches. The distance from shaft center to shank apex along the center line of the anchor is 18.78 inches.

In summary, the anchor operates and functions such as to pivot in two planes. The first plane is parallel to the sea bottom and provides directional adjustment changes along the center line of the anchor to correct for directional changes of the vessel. The second pivotal plane, the plane established when the anchor kicks up when it is trying to initially penetrate the sea bottom which allows pivotal motion along the circular arc shaped shank arm on one side or the other, the pivoting acting to increase the penetration angle by the interaction of fluke point drag as it passes along the sea bottom and the pulling force on the shank apex where the line is connected to the anchor.

It should be noted that the shank arms and the rear cross frame member in their connection are smooth and that there are no projections on the outside frame of the anchor. The smoothness around the periphery of the frame insures that the anchor does not become fouled in weeds or with the anchor line itself.

The instant invention has been shown and described herein in what is considered to be the most practical and preferred embodiment. It is recognized, however, that departures may be made therefrom within the scope of the invention and that obvious modifications will occur to a person skilled in the art.

What I claim is:

1. A non-fouling fluke anchor comprising:

a movable fluke having a generally pointed apex and a base opposite said apex;

a fluke moving means connected to the base of said fluke for directing said apex into the sea bottom;

a frame including;

a base portion, and a shank portion having a pair of continuously convex arcuate arms joined together at one end thereby forming a frame apex and connected together by said base portion at the other end, said fluke being moveably connected within said convex arcuate arms and to said frame by transverse connecting means, said continuously convex arcuate arms form a generally circular arc from said frame apex to said base portion whereby said base portion is connected at about right angles to said arcuate arms and wherein said circular arc has a radius equal to approximately twice the transverse width of the anchor, and when said anchor is positioned in a three point stance on the penetrating surface with said frame apex as one point, said apex of said fluke as the second point, and a single point of contact, the third point is on said circular arc of said shank, said frame and said fluke are being designed and sized to provide an angle of penetration of said fluke that continuously increases as said third point moves along said circular arc from said base portion to said apex of said frame, said angle of penetration varies from approximately 15 degrees to 67 degrees, the distance between the apex of said fluke and the moveable said third point of contact along the shank increases as said third point moves along said arcuate arms from said base portion of said frame apex.

said fluke moving means includes a pair of diverging trailing plates, said fluke, said fluke moving means, said shank portion, said base portion and said transverse connecting means are devoid of projections outside the frame of the anchor.

2. A non-fouling fluke anchor comprising:

a moveable fluke, said fluke having a pointed apex and a base opposite said apex but otherwise devoid of projections, a pair of diverging trailing plates connected to the base of said fluke, said trailing plates being trapezoidally shaped but otherwise devoid of projections;

a shank comprised of a pair of continuously convex arcuate arms joined together at one end forming an apex and connected together by a base portion at the other end, said fluke being connected to said convex arcuate arms by a shaft, said continuously convex arcuate arms forming a circular arc from said apex to said base portion, said circular arc having a radius equal to approximately twice the major width of the anchor, said continuously convex arcuate arms having a single point of contact moving along said circular arc while contacting the surface contacted by said fluke apex thereby increasing the angle of penetration of said fluke from approximately 15 degrees to 67 degrees and increasing the distance between said fluke and said moveable contact point, said base portion being engaged by one trailing plate forming a 90 degree angle with the opposite trailing plate, said shank and base portion being otherwise devoid of projections.

3. A non-fouling fluke anchor as set forth in claim 2 wherein said fluke is triangular in shape with said apex having an angle of approximately fifty-three degrees.

4. A non-fouling fluke anchor as set forth in claim 2 wherein said fluke has a center line length substantially equal to one-half of the center line distance from said shank apex to said base portion.

5. A non-fouling fluke anchor as set forth in claim 2 wherein one trailing plate forms approximately a 90 degree angle with the plane of said shank when the opposite trailing plate is forced into engagement with said base portion by the sea bottom thereby causing the anchor to substantially set.

* * * * *